US006170175B1

(12) United States Patent
Funk

(10) Patent No.: US 6,170,175 B1
(45) Date of Patent: Jan. 9, 2001

(54) FOOTWEAR WITH INTERNAL REINFORCEMENT STRUCTURE

(76) Inventor: Douglas Funk, 4756 U. Vill. Pl. NE. #186, Seattle, WA (US) 98105

( * ) Notice: Under 35 U.S.C. 154(b), the term of this patent shall be extended for 0 days.

(21) Appl. No.: 09/207,550

(22) Filed: Dec. 8, 1998

(51) Int. Cl.[7] ..... A43B 7/20
(52) U.S. Cl. ..... 36/89; 36/115; 36/117.1; 36/92; 36/57; 36/58.5
(58) Field of Search ..... 36/89, 115, 90, 36/117.1, 92, 57, 58.5

(56) References Cited

U.S. PATENT DOCUMENTS

| | | | | |
|---|---|---|---|---|
| 210,529 | * | 12/1878 | Hauber . | |
| 325,280 | * | 9/1885 | Smadbeck et al. . | |
| D. 386,294 | * | 11/1997 | Brooks et al. . | |
| 975,820 | * | 11/1910 | Azzara . | |
| 1,283,335 | | 10/1918 | Shillcock . | |
| 1,291,092 | * | 1/1919 | Ockrassa . | |
| 1,305,782 | * | 6/1919 | Dreyling . | |
| 1,548,172 | * | 8/1925 | Redden . | |
| 1,845,031 | | 2/1932 | Arthur . | |
| 2,300,155 | * | 10/1942 | Heintz . | |
| 2,634,515 | | 4/1953 | Saitta | 36/8.5 |
| 3,327,410 | | 6/1967 | Park, Sr, et al. | 36/2.5 |
| 3,439,434 | * | 4/1969 | Tangorra . | |
| 3,613,273 | * | 10/1971 | Marquis . | |
| 4,186,500 | * | 2/1980 | Salzman . | |
| 4,204,346 | * | 5/1980 | Fugere . | |
| 4,232,458 | * | 11/1980 | Bartels . | |
| 4,501,076 | * | 2/1985 | Dodds . | |
| 4,541,186 | * | 9/1985 | Mulvihill . | |
| 4,577,421 | | 3/1986 | Sartor | 36/119 |
| 4,621,648 | | 11/1986 | Ivany | 128/80 |
| 4,640,025 | | 2/1987 | DeRenzo | 36/50 |
| 4,922,630 | * | 5/1990 | Robinson . | |
| 5,152,082 | * | 10/1992 | Culpepper . | |
| 5,401,564 | * | 3/1995 | Lee et al. . | |
| 5,425,185 | | 6/1995 | Gansler | 36/50.1 |
| 5,678,330 | * | 10/1997 | Van Dyke et al. . | |
| 5,778,563 | * | 7/1998 | Ahlbaumer . | |

* cited by examiner

*Primary Examiner*—Ted Kavanaugh
(74) *Attorney, Agent, or Firm*—Ann W. Speckman; James Klansecki

(57) ABSTRACT

Footwear having one or more reinforcement features is disclosed. Footwear having two independent components constructed from a woven material with the strands oriented at specified angles to the plane of the sole of the footwear is disclosed. The footwear may also incorporate a substantially rigid structural collar in the area of the ankle or lower leg. Heel and/or forefoot straps that wrap downwardly and laterally around the heel and/or forefoot may be provided to limit flexing of the ankle and the footwear in a forward or backward direction, respectively. An internal reinforcement structure comprising a plurality of support strips arranged transversely to one another in a criss-cross arrangement is also disclosed.

14 Claims, 7 Drawing Sheets

FOOTWEAR WITH INTERNAL REINFORCEMENT STRUCTURE

FIELD OF THE INVENTION

The present invention relates to footwear having improved support, flexibility, comfort and structural properties and, optionally, footwear provided with an internal reinforcement system. The present invention also relates to methods for assembling and manufacturing footwear, and components that, when incorporated into footwear, provide improved support, flexibility, comfort and structural properties. The improved footwear, footwear components, and techniques of the present invention are particularly suitable for footwear for use in connection active outdoor applications, including boots for skiing, snow and water boarding, skating, including ice skating and in-line skating, hiking, and the like.

BACKGROUND OF THE INVENTION

Footwear designed for active sports, such as skiing, skating, hiking, and the like, is highly specialized. Yet, there are several common requirements. Such footwear must be somewhat stiff to provide support and protection for the foot, yet it must be somewhat flexible to permit movement and, to some degree, comfort. Generally, footwear designed for the more physically demanding sports applications, such as downhill skiing, in-line skating and mountaineering, has evolved to provide a rigid outer structure with movement provided only at certain pivot points. High performance footwear for such applications requires the footwear, and the sporting equipment to which it is fastened (skis, snowboards, skates, and the like) to closely match any movement of the foot, and footwear having a high degree of rigidity has generally been used for high performance applications as well. Because these boots have a rigid, unbreathable outer shell, they are generally quite uncomfortable, notwithstanding the use of cushioned and removable inserts designed to provide comfort for the foot.

Footwear having a somewhat "soft," flexible outer shell is available for some sporting activities, such as snowboarding, hiking and many athletic sporting activities. This footwear, while it is generally more comfortable, does not provide the structural rigidity necessary for safety and for many high performance and endurance activities.

The footwear, footwear components and methods of the present invention may employ a flexible outer shell in combination with an internal reinforcement system to provide the stiffness and flexibility required for high performance and endurance activities and may be adapted for a variety of footwear applications.

SUMMARY OF THE INVENTION

Footwear of the present invention exhibits improved comfort, flexibility, support and structural properties. According to one aspect of the present invention, footwear is constructed from a woven material, and preferably has two independent woven components having strands oriented in a particular orientation. The woven component(s) comprise at least two sets of strands oriented at generally right angles to one another and may compose an outer, inner or intermediate layer of the footwear. In this embodiment, one or more woven components is provided at the heel portion of footwear and one or more woven pieces is provided at the forefoot portion of the footwear. In a preferred embodiment, the woven heel and forefoot components are each constructed from an integral fabric piece and preferably form an inner, liner or an intermediate layer of the footwear.

The woven component provided at the heel portion of the footwear is constructed and assembled in the footwear so that a first set of strands is oriented generally at 90° to the plane of the sole of the footwear, and a second set of strands is oriented at about 90° to the first set of strands. The woven component provided at the forefoot portion of the footwear is constructed and assembled in the footwear such that one set of strands wraps laterally around and follows the contour of the forefoot, while another set of strands is oriented at about 90° to the first set of strands. In this embodiment, a first set of strands in the woven component forming the forefoot portion is oriented generally at 45° to the plane of the sole, and another set of strands is oriented at about 90° to the first set of strands. The heel and forefoot woven components are preferably joined to provide a footwear liner. This arrangement provides footwear that "hugs" and snugly retains the heel and forefoot in position in the footwear, even during athletic activities. Footwear constructed of woven heel and forefoot components in this fashion provides a high degree of flexibility and comfort, yet provides a degree of firmness and stability that is highly desirable for athletic activities.

According to another aspect of the present invention, footwear of the present invention preferably comprises a substantially rigid structural collar having one or more support straps mounted to the collar. The collar preferably encircles the ankle or lower leg of a person wearing the footwear and is adjustable and/or releasable to permit entry and withdrawal of the foot from the footwear. The collar may be positioned at the exterior or interior surface of the footwear, but is preferably-provided intermediate the exterior and interior surfaces, and may be provided, for example, as an intermediate component of a padded collar. The collar is preferably adjustable and may be tightened to snugly position the footwear after it has been placed on the foot.

One or more straps may be mounted to the collar to provide support and limit flexing of the ankle in a backward or forward direction, or in both backward and forward directions. Specialized straps may be provided for different athletic activities. The straps may be provided on the exterior of the footwear, or they may be provided proximate an interior lining or intermediate the exterior and interior surfaces of the footwear. In one embodiment, external straps are provided that criss-cross the heel portion of the footwear to provide forward support, and to limit flexing of the ankle in a forward direction. Thus, one strap is mounted to the collar at a medal side portion of the footwear and wraps downwardly around the heel and laterally to a lower position on the other side of the footwear. Similarly, another strap is mounted to the collar at the lateral side portion of the footwear and wraps downwardly around the heel and laterally to a lower position at the medial side of the footwear. These straps criss-cross at a generally central heel portion of the footwear and provide support that resists forward bending of the ankle.

Alternatively or additionally, another set of straps may be provided that criss-crosses the forefoot portion of the footwear. Thus, one strap may be mounted to the collar at a medial side portion of the footwear and extends downwardly and laterally across the top of the forefoot to a lower position on the lateral side of the footwear. Similarly, a second forefoot strap may be mounted to the collar at a lateral side of the footwear and extends downwardly and laterally across the top of the forefoot to a lower position at the medial side of the footwear. These forefoot straps criss-cross at a generally central forefoot portion of the footwear and provide support that resists backward bending of the ankle. The heel and forefoot straps may be used independently of in combination, depending on the support desired for particular footwear applications.

The straps themselves may be flexible, or they may be substantially rigid, and they are preferably adjustable to provide a desired degree of support. The straps may be rigidly mounted to the collar, but are preferably pivotably mounted to the collar at a common pivot point. According to an especially preferred embodiment, one or both sets of straps are provided on the exterior of the footwear and are removably or releasably mounted to the collar at a common pivot point to provide a high degree of support, flexibility and comfort.

Yet another aspect of the present invention relates to an internal reinforcement structure mounted to and extending below the substantially rigid collar. The internal reinforcement structure is preferably mounted intermediate the substantially rigid collar and the sole of the footwear. This reinforcement structure provides a high degree of structural firmness and support, yet it does not compromise the flexibility and comfort of the footwear. It serves to limit compression along a generally vertical axis, yet permits limited lateral flexing of the ankle portion of the footwear article.

According to preferred embodiments, the internal reinforcement structure comprises a plurality of strips that criss-cross the heel portion of the footwear and are pivotably mounted to the collar and a lower structural portion of the footwear intermediate the exterior and interior surfaces of the footwear. The reinforcement strips are preferably constructed from a material that is substantially non-stretchable and non-compressible in the direction of its longitudinal axis, but that is flexible to permit limited lateral and front to back flexing of the ankle and lower leg. Numerous exemplary embodiments are described below and may be adapted for use in various footwear applications.

Although the internal reinforcement structure is described generally as a criss-crossing multiple strip or webbed structure, it will be understood that other structures, such as perforated structures, layered structures, and the like, may also provide the desired internal reinforcement and are contemplated by the present invention. Structures having support elements that criss-cross around the heel are contemplated.

The various aspects of footwear construction and structural components may be used alone or in combination to provide the improved footwear of the present invention. Numerous exemplary embodiments are described below, but the invention is not intended to be limited to these specific embodiments.

DESCRIPTION OF THE FIGURES

Preferred embodiments of the present invention will be described with reference to the figures, in which.

DESCRIPTION OF PREFERRED EMBODIMENTS

Footwear, methods and components of the present invention are described below with reference to certain preferred embodiments of components and footwear, such as boots and athletic footwear. The methods, components and footwear of the present invention are not limited for use in such applications or in connection with component assemblies and footwear having similar configurations or properties. Broadly, the methods and components of the present invention may be used to provide footwear of many types providing improved comfort, performance and structural properties.

Figure 1:
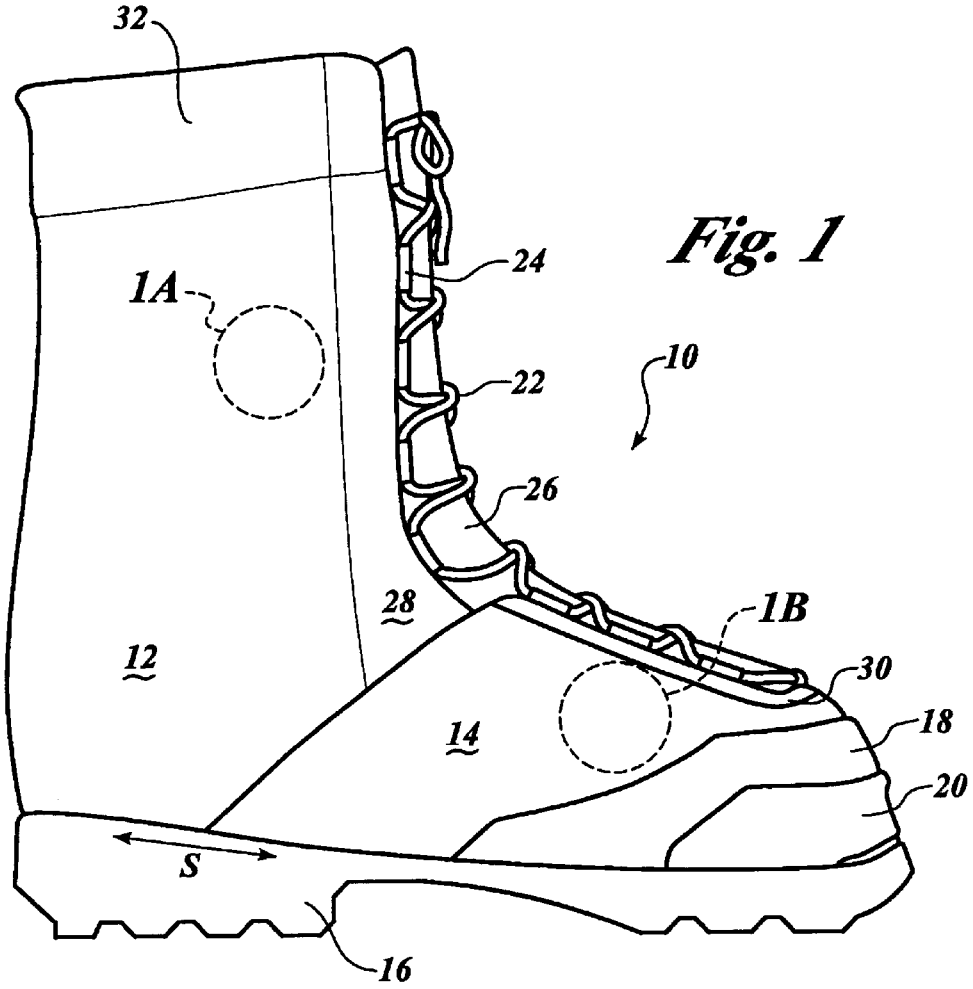
FIG. 1 illustrates footwear of the present invention comprising a woven heel component and a woven forefoot component.

FIG. 1 illustrates a boot 10 embodying several features of improved footwear of the present invention. The boot comprises an exterior heel component 12 mounted to an exterior forefoot portion 14, with both the heel and forefoot components mounted to an insole (not shown) and an outsole 16. Toe portions 18 and 20 are preferably reinforced using rubber or various synthetic compounds, as is known in the art. Boot 10 may employ standard construction techniques with a standard closure structure including lacing 22 threaded through eyelets 24 and criss-crossing a tongue 26 mounted between the split that permits entry and withdrawal of the foot from the footwear.

Figure 1A:
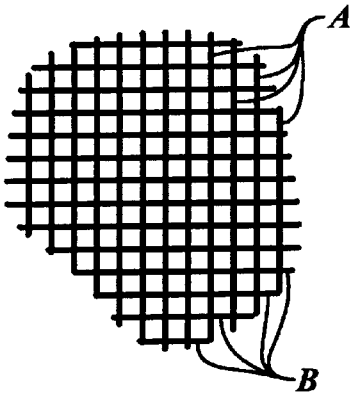
FIG. 1A shows an enlarged view of the orientation of the strands of the woven component comprising heel portion of the footwear.

A heel component 12 of the present invention preferably comprises a woven material having at least two sets of strands oriented at generally right angles to one another. Thus, as shown in the enlarged diagram of FIG. 1A, heel component 12 comprises a woven material comprising a plurality of strands A oriented generally vertically and a plurality of strands B oriented generally horizontally with reference to the plane of the sole S. The strands intersect one another at generally right angles. Footwear of the present invention is assembled such that the woven material of heel component 12 is oriented generally as shown in FIG. 1A, with one set of strands B being oriented generally parallel to a flat surface S on which the footwear is used, and a second set of strands A being oriented generally at right angles to the plane of the sole S.

Forefoot component 14 of the present invention preferably comprises a woven material having at least two sets of strands oriented at generally right angles to one another and oriented generally transverse to the orientation of the strands comprising woven heel component 12. Thus, as shown in the enlarged diagram of FIG. 1B, forefoot component 14 comprises a woven material comprising a plurality of strands C intersecting a plurality of strands D at generally right angles. Strands C and D are oriented generally transversely to strands A and B of woven heel component 12.

Figure 1B:
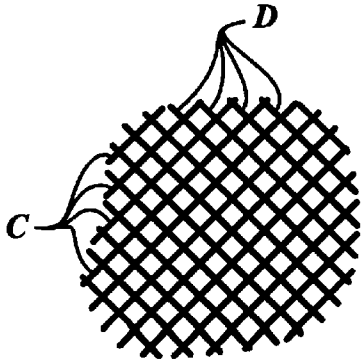
FIG. 1B shows an enlarged view of the orientation of the strands of woven component comprising forefoot portion of the footwear.

Footwear of the present invention is assembled such that the strands of woven forefoot component 12 are oriented generally as shown in FIG. 1B, with one set of strands C being oriented at about 45° to a the plane of sole S, and the second set of strands D being oriented generally at about 135° to the flat surface S on which the footwear is used. Although footwear constructed in conformity with the angles specified above is preferred, variations of about 15° in either direction from the specified angles are contemplated and may be tolerated while still providing benefit. Similarly, strands of the woven fabric are preferably at generally right angles, although variation on the order of from 80° to 100° may be tolerated.

Woven heel portion 12 may be an integral component constructed from a plurality of similarly oriented woven components joined to one another, but it is preferably provided as a unitary woven piece, as shown, that wraps around the heel and is mounted to a reinforced closure structure 28, or to another component in proximity to the footwear closure. Woven heel component 12 preferably substantially spans the height of the footwear and, as shown, extends from the sole to a padded collar 32. Similarly, woven forefoot portion 14 may be an integral component constructed from a plurality of similarly oriented woven components joined to one another, but it is preferably provided as a unitary woven piece, as illustrated in FIG. 1, or as two mirror image side (medial and lateral) forefoot sections having a similar configuration and orientation. In this configuration, each side forefoot section preferably extends from the sole 16 to reinforced closure structure 30. The woven forefoot components may be attached to one another and to the other structural components of the footwear using conventional footwear construction techniques.

The woven heel and forefoot components may form an interior lining of footwear, or they may be provided as the exterior of the footwear, as shown in FIG. 1. Generally, it is preferred that the woven heel and forefoot components are assembled to provide an integral liner that is fastened to an outer or other footwear components as is well known in the art.

Figure 2:
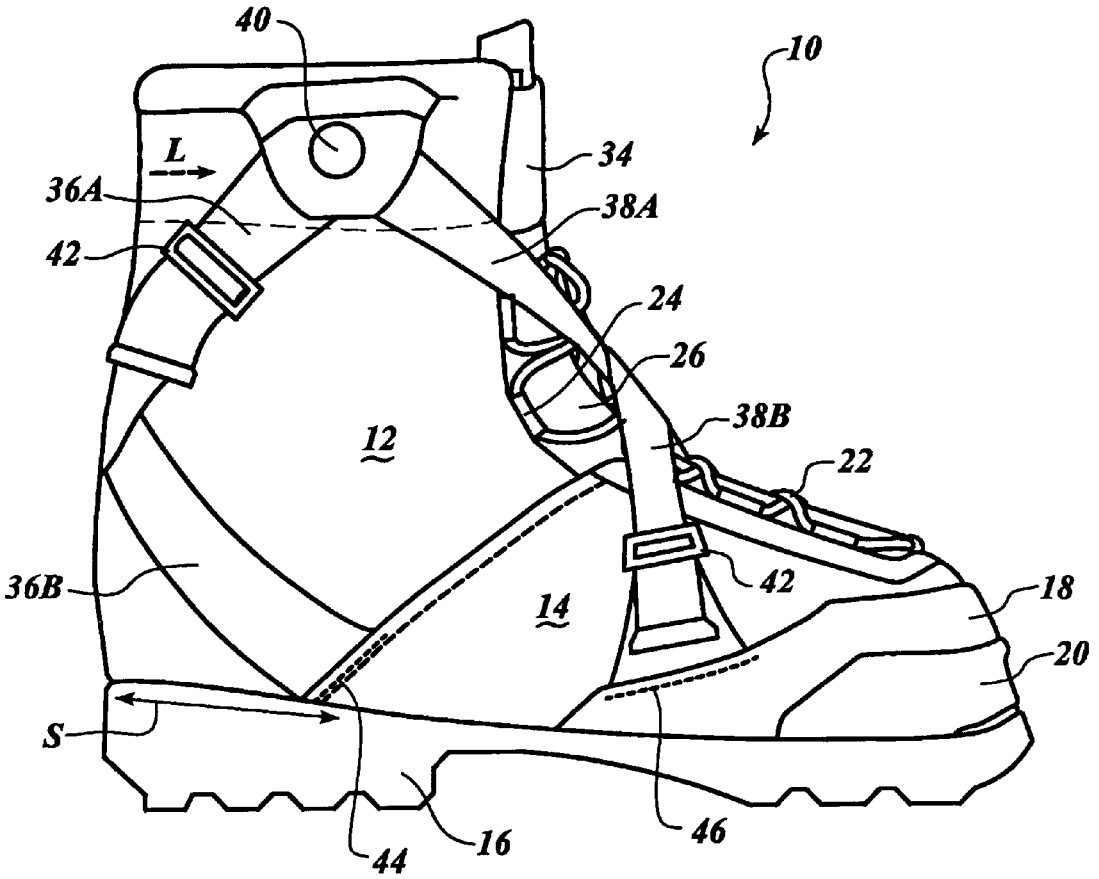
FIG. 2 illustrates footwear of the present invention employing both heel and forefoot external straps mounted on the exterior of the footwear.

The woven material comprising woven heel component 12 and woven forefoot component 14 preferably comprises at least two sets of strands oriented at generally right angles to one another. Additional strands may be provided in other orientations. The woven material preferably has a high strength and is biased, that is, the fabric does not move or "stretch" in the direction of the grain (the strands, as described), but it may move, or shift, in a direction at an angle to the grain. The strands themselves are preferably non-stretchable, but the shifting of the strands with respect to one another provides a limited degree of "stretch" at an angle to the grain. Natural and/or synthetic materials may be used, depending on the footwear application. Woven materials that provide a degree of breathability are preferred. Heavy gauge nylon cordura materials may be used, for example, for outdoor athletic footwear applications. Lighter gauge woven materials may be used for athletic footwear for court sports, such as basketball, tennis, squash, handball, racket ball and the like, having woven heel and forefoot components assembled as described above. Specialized outsoles and other footwear features may be provided depending on the particular application. FIG. 2 illustraes another feature of footwear of the present invention that may be employed in combination with or independently of the woven heel and forefoot components described above. Footwear components illustrated in FIG. 2 and the remaining figures incorporate the numerals used in connection with the corresponding components described above. The improved structural components of FIG. 2 include a structural collar 34 provided generally above the ankle and, preferably, in proximity to the top of the footwear. Collar 34 encircles lower leg portion of the wearer above the ankle and provides an attachment point for optional structural reinforcement components of the present invention. Structural collar 34 is preferably exposed to the exterior of the footwear at some point around its perimeter to provide for a release and/or adjustment mechanism permitting entry of the foot into and withdrawal of the foot from the footwear. Conventional release and/or adjustment mechanisms, such as buckles, cinch mechanisms, and the like, may be used and are not illustrated.

Collar 35 may be provided on an exterior or interior surface of the footwear, but it is preferably provided intermediate the exterior and interior surfaces and, according to a preferred embodiment, may be provided in proximity to a padded collar for comfort and ease of construction. Collar 34 preferably comprises a material that is substantially rigid, and that is not stretchable along its longitudinal axis (arrow L), but may be somewhat flexible in other directions.

The material comprising collar 34 has high flexural strength so that it conforms to the ankle or leg of the wearer during activities, yet remains a semi-rigid and durable structure for mounting and supporting additional structural components. Materials such as reinforced fiberglass, semi-rigid plastics, synthetic resins, metallic sheet materials, and composite materials are preferred. Injection molded plastics are preferred materials. Collar 34 may be provided as a strip having a generally uniform width and thickness, or portions of the collar that serve as attachment points may be reinforced by providing, for example, additional material. Collar 34 is preferably at least 0.5 inch wide (width indicated as "W"), and more preferably at least about 0.75 inch wide.

Collar 34 may provide an attachment point, for example, for heel straps 36A and 36B and/or forefoot straps 38A and 38B. Heel straps 36A and 36B may be affixed at attachment points 40 provided in corresponding locations on the medial and lateral portions of collar 34. In the embodiment shown in FIG. 2, one end of strap 36A is affixed to collar 34 at attachment point 40 on collar 34 on medial portion of the footwear and the other end extends in a criss-cross fashion around the heel portion of the footwear, and is anchored on the lateral portion of the footwear in proximity to the sole. The matching heel strap 36B is affixed at an attachment point 40 on collar 34 on the lateral portion of the footwear and the other end extends in a criss-cross fashion around the heel portion of the footwear, and is anchored on the medial portion of the footwear in proximity to the sole, as shown.

Similarly, one end of forefoot strap 38A is affixed to collar 34 at an attachment point on a medial portion of the footwear and extends in a cross-cross fashion across the upper forefoot portion of the footwear and across the closure system, and is anchored on the lateral portion of the footwear in proximity to the sole. The matching forefoot strap 38B is affixed at an attachment point on collar 34 on the lateral portion of the footwear, extends in a cross-cross fashion across the forefoot portion of the footwear, and is anchored on the medial portion of the footwear in proximity to the sole, as shown. Forefoot straps 38A and 38B are preferably attached to the footwear intermediate the arch and the toe portion, and may attached to an enlarged, reinforced toe portion 18 at seam 46, as shown in FIG. 2.

Heel and forefoot straps are preferably provided on the exterior of the footwear but may be provided adjacent an interior surface or lining of footwear, or may be provided intermediate the exterior and interior surfaces of the footwear. Exterior placement is preferred for comfort and accessibility. Support straps 36A, 36B, 38A and 38B are preferably adjustable using, for example, buckle mechanisms 42. Each strap is preferably independently adjustable to provide specialized and independent adjustment. Straps 36A, 36B, 38A and 38B may be rigidly or pivotably attached to collar 34 at attachment points 40. Attachment mechanisms that provide both pivotable and releasable attachment of external straps 36 and 38 to collar 34 are preferred and are known in the art. Pivotable and releasable attachment of the external straps may be provided, for example, by rigidly mounting one or more pins on collar 34, with each of the pins penetrating to and protruding a bit from the exterior of the footwear at an enlarged head. According to this embodiment, external straps 36 and 38 may be provided with one or more reinforced eyelets that may be mounted on the enlarged head to engage the external straps and removed from the enlarged head to disengage the external straps. Multiple pins may be provided to accommodate multiple attachment points for the external straps. In this fashion, one or more pivotable attachment points for the external straps may be provided.

The other ends of straps 36A, 36B, 38A and 38B may be attached at a seam of the footwear, as shown at seams 44 and 46, or may be sewn or otherwise fastened between the upper and the sole. Support straps 36A, 36B, 38A and 38B are preferably substantially non-stretchable in the direction of their longitudinal axes L, but flexible to conform to the contour of the footwear and to provide some flexing during activity. A limited degree of stretch in the direction of longitudinal axes L may be preferred for many types of athletic footwear. Woven webbing material, flexible plastics, and the like are suitable.

Heel straps 36A and 36B are employed in footwear applications in which it is desirable to limit flexing of the ankle in a forward direction. Similarly, external forefoot straps 38A and 38B are employed in footwear applications in which it is desirable to limit flexing of the ankle in a backward direction. Heel and forefoot straps may be provided independently of one another, or footwear of the present invention may comprise both heel and forefoot straps, as illustrated in FIG. 2. According to a preferred embodiment, heel and forefoot straps are releasably and pivotably attachable at common attachment points 40 on the medial and lateral portions of collar 34.

Yet another aspect of the present invention relates to an internal reinforcement structure that provides limited side to side flexing of the ankle but snugly retains the heel portion of the foot and provides for limited movement and flexing of the boot in accordance with the movement of the foot. Internal reinforcement structures of the present invention may be provided having varying degrees of stiffness, and thereby enhancing various footwear performance characteristics. The internal reinforcement structure may be employed with a flexible outer shell comprising leather, fabric, or a flexible plastic material, or a combination of such materials, to provide footwear having a higher degree of support and rigidity, without requiring a rigid outer shell. Thus, the desirable performance characteristics of footwear constructed from substantially rigid materials may be provided in footwear constructed from more comfortable, breathable materials using the internal reinforcement structure of the present invention.

The internal reinforcement structure is preferably mounted intermediate the exterior and interior surfaces of the footwear. Because the internal reinforcement structure is flexible, it conforms to the shape of the foot and moves to accommodate movement of the ankle in lateral directions, yet it provides firmness and stability characteristic of footwear having rigid or semi-rigid outer shells, such as ski boots. The internal reinforcement structure of the present invention may be provided using a variety of structures, ranging from a perforated sheet of material, such as a plastic material, to the support strips described below.

Figure 3:
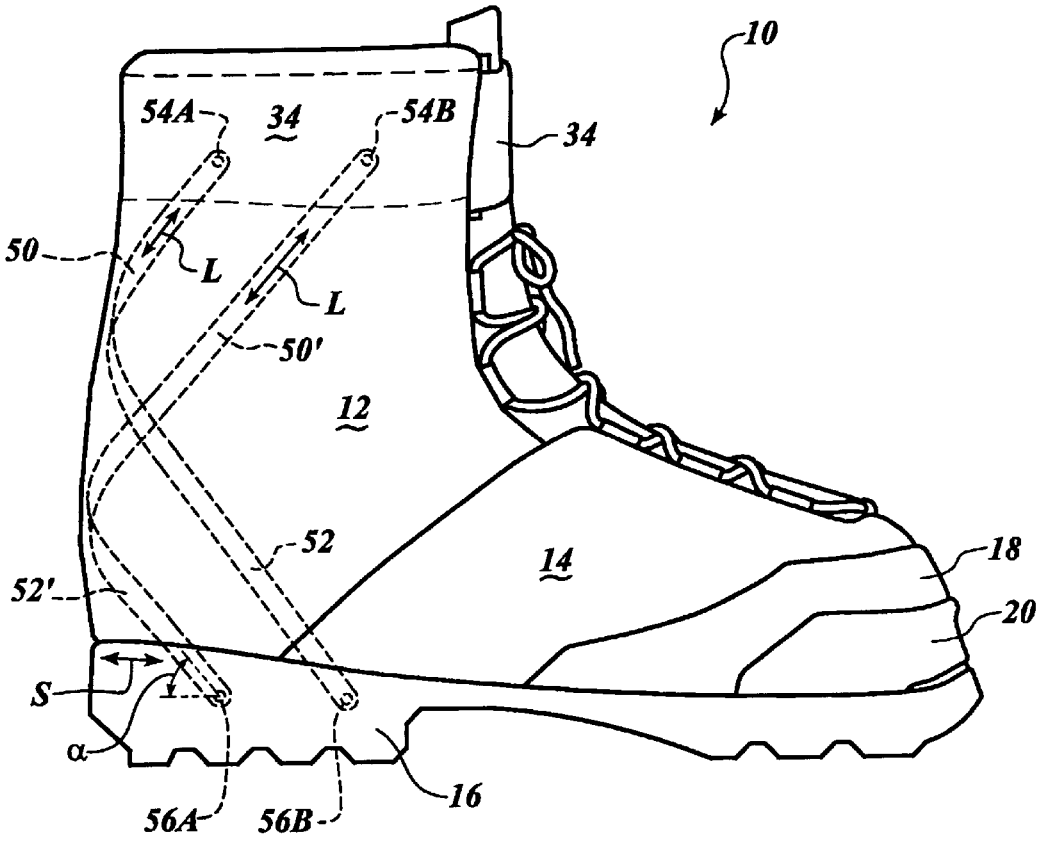
FIG. 3 illustrates footwear of the present invention having an internal reinforcement component intermediate outer and inner surfaces of the boot, with the internal reinforcement component shown in dashed lines.

FIG. 3 illustrates a simplified internal reinforcement structure of the present invention. This reinforcement structure comprises at least two support strips 50 and 52 that criss-cross around the heel portion of the footwear. One end of support strips 50 and 52 is mounted on structural collar 34 at corresponding attachment points 54 on medal and lateral portions of collar 34, while the other end is mounted to a structural footwear component in proximity to the sole at corresponding attachment points 56. Attachment of strips 50 and 52 to collar 34 at attachment points 54, and to a structural portion of the footwear at attachment points 56, is preferably pivotable and may be provided, for example, by rivets.

Preferred internal reinforcement structures of the present invention comprise at least four support strips mounted to an upper collar, the strips criss-crossing one another around the heel portion of footwear, as shown in FIG. 3. In this embodiment, downward movement of collar 34 is prevented and the heel is snugly retained in the heel portion of the footwear, while side to side flexing of the ankle and leg is permitted. In this preferred embodiment, two strips 50 and 50' cross downwardly from the medial side to the outer lateral side of the footwear, while two strips 52 and 52' cross downwardly from the outer lateral side to the inner medial side of the footwear. Each pair of strips 50, 50' and 52, 52' is preferably mounted so that the strips follow paths that are substantially parallel to one another. And, the criss-crossing pairs of support strips are preferably arranged in a substantially mirror image relationship. According to a preferred embodiment, strips 50, 50', 52 and 52' for an angle $\alpha$ of about 35° to about 60° with the plane of sole S.

Support strips 50, 50' and 52, 52' are non-stretchable in the direction of their longitudinal axes L, but are bendable and flexible to conform to the configuration of the footwear and the foot. Strips 50, 50', 52 and 52' are preferably fabricated, for example, from reinforced fiberglass, relatively thin layers of metals, such as spring steel, substantially rigid plastics, synthetic resins, composite materials, and the like. In a preferred embodiment, thin metallic strips comprising, for example, spring steel may be curved to the desired shape for crisscrossing the heel portion and then heat treated to enhance the hardness and rigidity of the strips.

The configuration, width and thickness of support strips varies with the type of footwear, the materials and construction of the other footwear components, the type of reinforcement structure, and the like. In general, the support strips preferably have a width of at least about 1/16" and, more preferably at least about 1/8." Support strips having a generally small thickness are preferred to provide greater comfort and to reduce interference with the fit and movement of the footwear. Reinforcing strips 50, 50', 52, 52' are preferably positioned intermediate the exterior and interior surfaces of the footwear.

The exterior layer of the footwear may be constructed from a material that has a moderate degree of stiffness and serves to contain any outward flexing of reinforcing strips 50, 50', 52, 52'. Various plastic materials, leather and reinforced fabric materials are suitable. Alternatively or additionally, containment of the reinforcing structure may be provided by inserting another layer intermediate the exterior surface of the footwear having a reinforcing structure wrapping horizontally around the heel.

Figure 4:
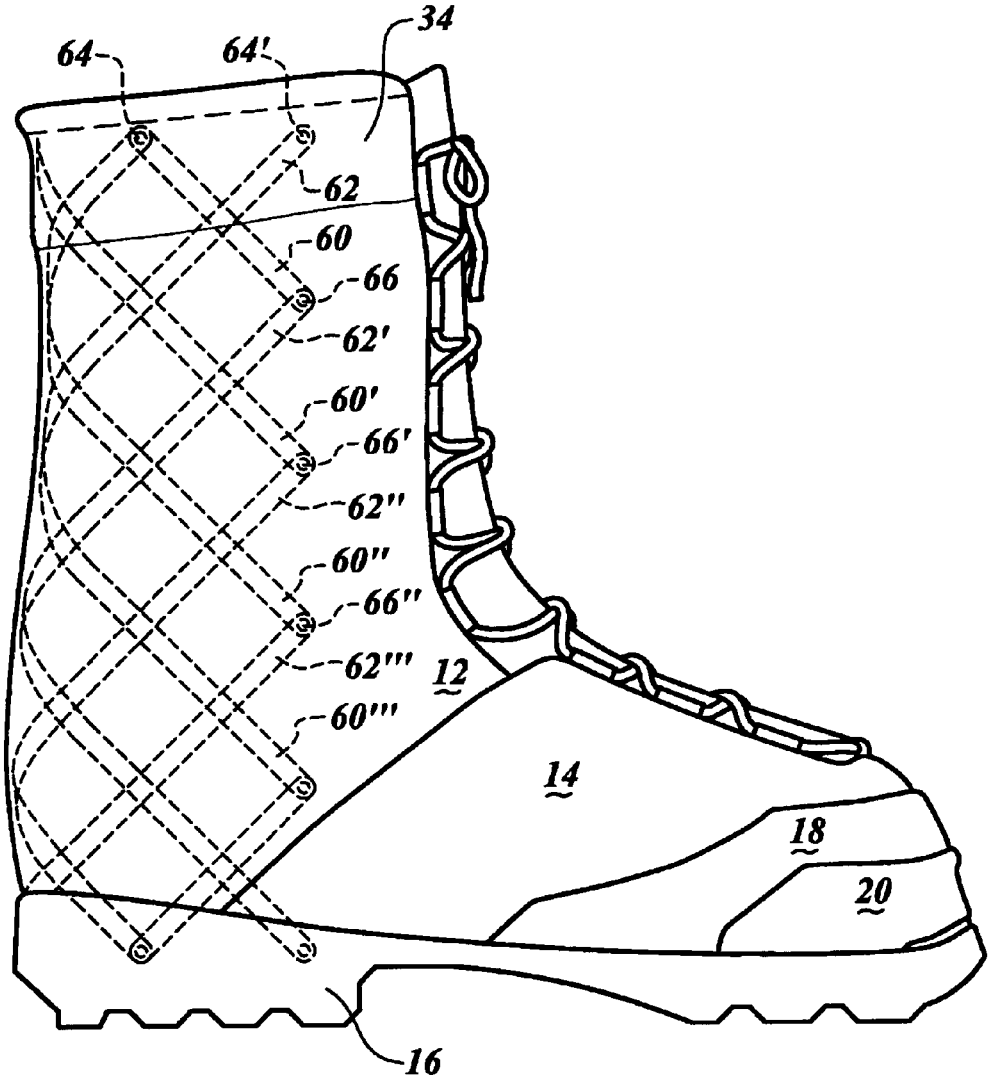
FIG. 4 illustrates another embodiment of footwear of the present invention having an internal reinforcement component mounted intermediate outer and inner surfaces of the boot, the reinforcement component being shown in dashed lines.

FIG. 4 illustrates yet another internal reinforcement structure of the present invention. According to this embodiment, a plurality of transverse strips 60, 60', 60", etc. and 62, 62', 62", etc. criss-cross one another and are anchored, at opposite ends, to collar 30 and/or a structural component of the footwear in proximity to the sole, or to another strip. Thus, support strip 60 is fastened to collar 34 at attachment point 64 and to support strip 62' at attachment point 66. Similarly, support strip 62 is attached to collar 34 at attachment point 64", and is attached to a transverse support strip terminating above the sole at an attachment-point (not shown). According to preferred embodiments, support strips 60 and 62 do not fasten to both collar 34 and an attachment point near the sole. Rather, strips that are fastened to an attachment point on collar 34 attach, at their other ends, to the terminal end of a transverse strip located between collar 34 and the sole. Similarly, strips that are fastened in proximity to the sole attach, at their other ends, to the terminal end of a transverse strip located between collar 34 and the sole. In this fashion, a regular network of criss-crossing support strips is provided, with terminating intersections 66, 66', 66", etc., on both the medial and lateral sides of the heel portion of the footwear.

Support strips 60, 60', 60", etc. and 62, 62', 62", etc., are preferably attached to collar 34 or a structural component of the footwear in proximity to the sole, and to the terminal ends of corresponding transverse strips using pivotable attachment means such as rivets or the like. Thus, each support strip is pivotable about each attachment point. Strips 60, 60', 60", etc., are preferably arranged substantially parallel to one another and at substantially right angles to strips 62, 62', 62", etc. Likewise, strips 62, 62', 62", etc., are preferably arranged substantially parallel to one another and at substantially right angles to strips 60, 60', 60", etc. Transverse strips may overlie or underlie one another, but it is preferable that one set of strips, illustrated as strips 62, 62', 62", etc., overlie or underlie the other set of strips. The number, size and configuration of support strips may vary, depending on the footwear application and the degree of structural rigidity or flexibility desired. Thus, the illustrated embodiment employs six sets of transverse support strips. Various applications may employ from two to twelve or more sets of support strips of varying sizes and configurations. The support strips are preferably constructed from the materials described above.

Figure 5:
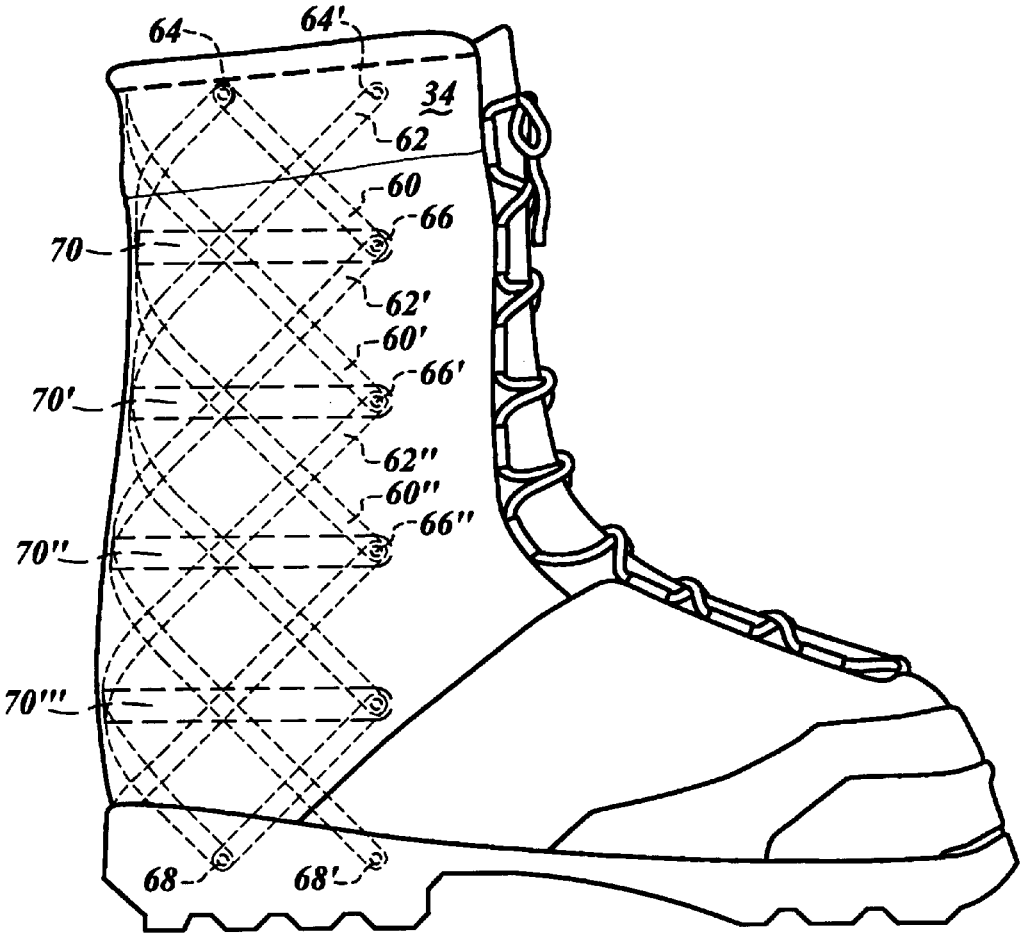
FIG. 5 illustrates still another embodiment of footwear of the present invention having an internal reinforcement component mounted intermediate outer and inner surfaces of the footwear, with the outer layer of the footwear removed to illustrate placement and structure of the reinforcement component.

FIG. 5 illustrates yet another embodiment of an internal reinforcement component and footwear of the present invention incorporating the internal reinforcement component. According to this embodiment, transverse support strips 60, 60', 60", etc. and 62, 62', 62", etc., are provided and, additionally, strips 70, 70', 70", etc. are provided in a generally horizontal orientation and attached to the reinforcement structure, preferably using pivotable attachment means, at attachment points 66, 66', 66", etc. One or more horizontal support strips may be provided, depending on the degree and type of reinforcement support desired. For certain applications, for example, a single horizontal support strip may be provided in a central area between collar 34 and the sole. This strip may be wider or thicker than the transverse strips to provide additional support. Alternatively, support strips 70 and 70'" may be provided only in proximity to collar 34 and the sole of the footwear. Yet another embodiment may provide support strips 70, 70', 70", etc., in a different criss-cross pattern from underlying transverse support strips 60, 60', 60" and 62, 62', 62", etc.

Figure 6:
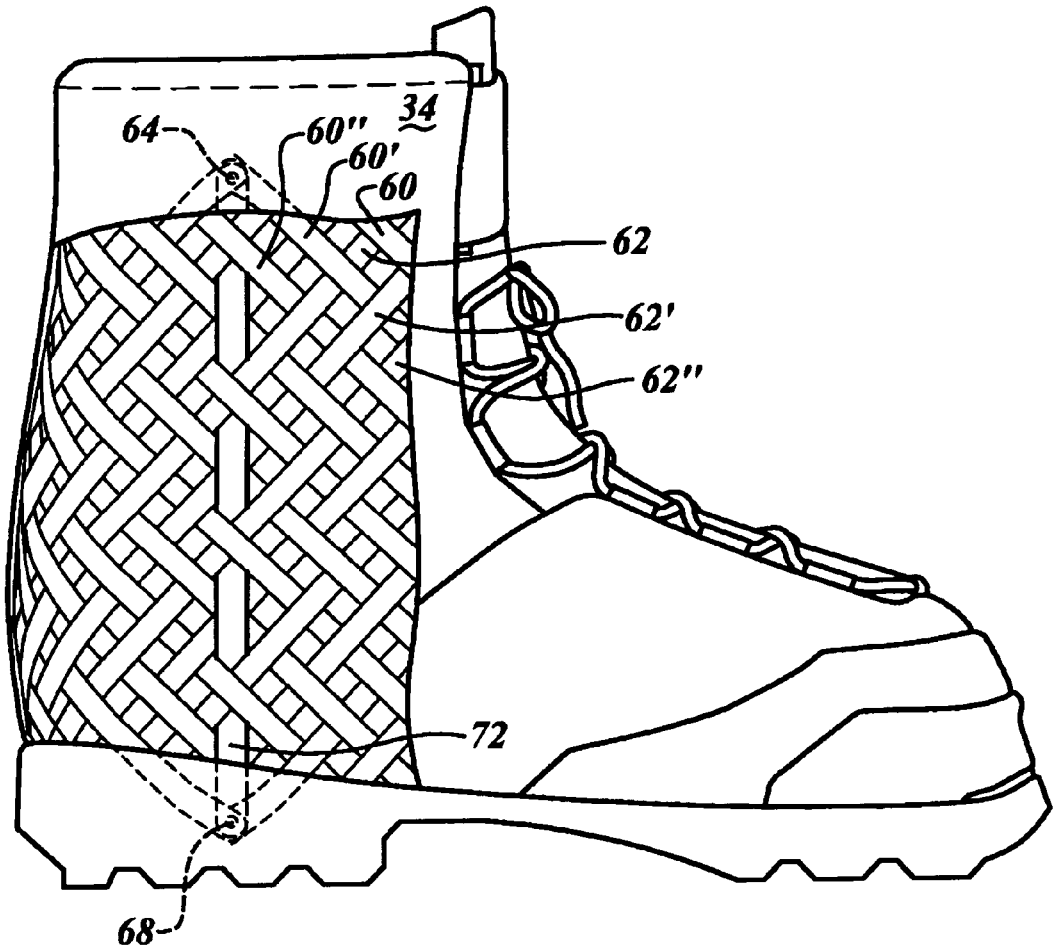
FIG. 6 illustrates another embodiment of footwear of the present invention having an internal reinforcement component intermediate outer and inner surfaces of the footwear, with the outer layer of the footwear removed to illustrate placement and structure of the intermediate reinforcement component.

FIG. 6 illustrates yet another embodiment of the internal reinforcement structure of the present invention in which transverse support straps 60, 60', 60", etc., and 62, 62', 62", etc., overlie and underlie one another in a woven pattern. Additionally, a vertical support strip 72 may be provided that is attached at attachment points 64 and 68 to provide a different degree or type of reinforcement. For certain applications, for example, a single vertical support strip may be provided in a central medial and in a central lateral location of the reinforcement structure as it is mounted in the footwear or, for other applications, a plurality of vertical strips may be provided. The vertical strip(s) may be thicker or thinner and narrower or wider than the transverse strips.

Figure 7:
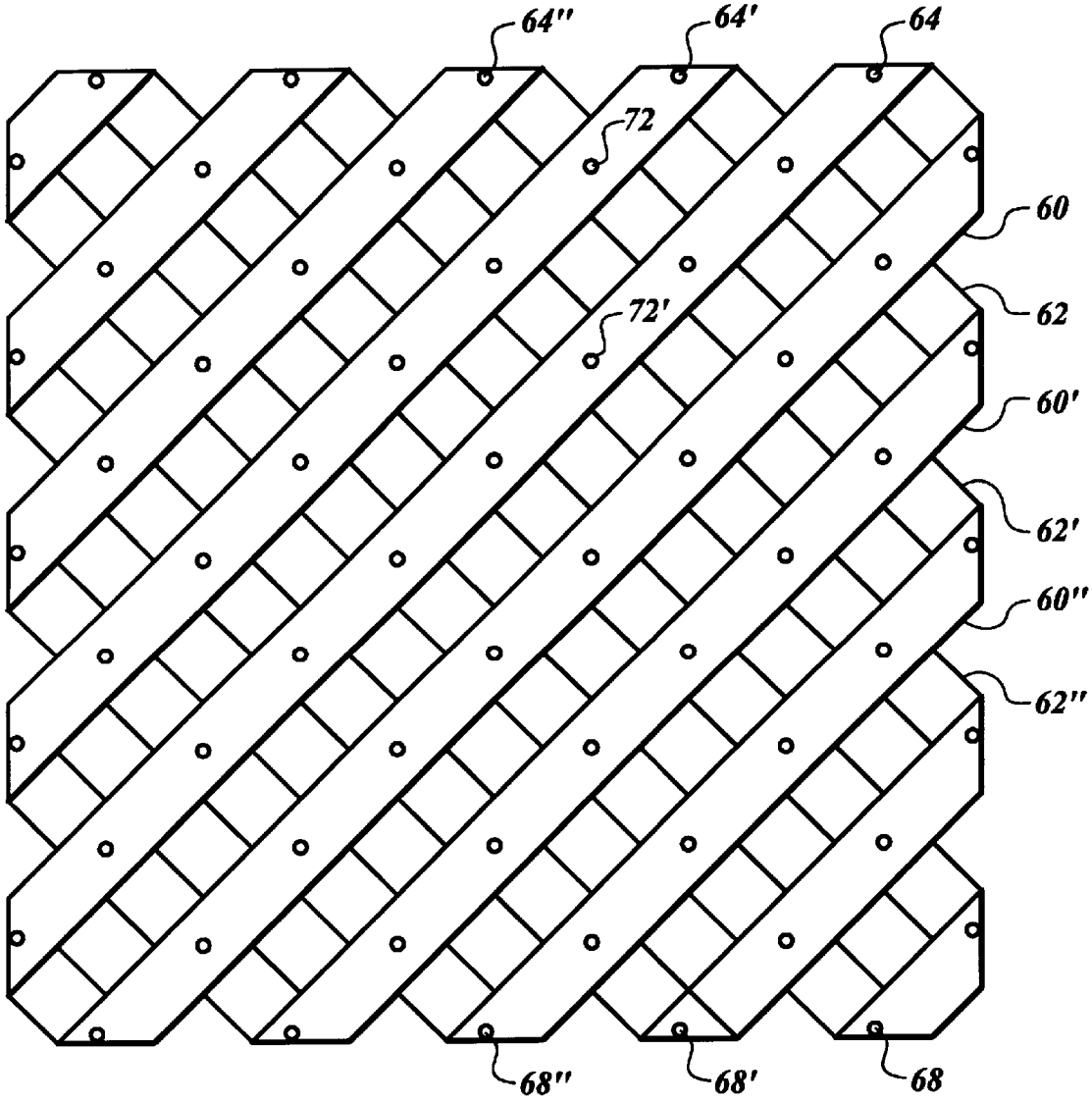
FIG. 7 illustrates an internal reinforcement component of the present invention that may be positioned intermediate outer and inner layers of footwear to provide improved comfort and structural properties.

FIG. 7 illustrates an internal reinforcement component of the present invention. Such a component may be assembled in a planar orientation, as shown, and then mounted in the footwear by attaching the transverse support strips to attachment points 64 and 68 on the collar and in proximity to the sole, respectively. The internal reinforcement component illustrated in FIG. 7 incorporates another optional feature of the present invention. Transverse support strips 60, 60', 60", etc., and 62, 62', 62", etc., are attached not only at attachment points 64, 66 and 68, but also at attachment points 72 where the transverse strips intersect one another. Attachment points 72 preferably provide pivotable attachment of the transverse strips to one another. The internal reinforcement component illustrated in FIG. 7 may be pre-assembled, and then mounted in the footwear during assembly of the footwear components. This may be accomplished, for example, by attaching the ends of intersecting transverse strips to collar 34 at attachment points 64, 64', 64", etc., and by attaching the other ends of intersecting transverse strips to a structural component of the footwear in proximity to the sole. The internal reinforcement component is preferably installed at a location intermediate the outer and the inner surfaces of the footwear.

I claim:

1. An article of footwear comprising an internal reinforcement structure mounted in a heel portion of the footwear article intermediate an entry portion of the footwear permitting entry of the foot into and withdrawal of the foot from the footwear article and the sole of the footwear, the internal reinforcement structure comprising at least one pair of support strips mounted on a structural collar, the support strips criss-crossing the heel portion of the footwear with at least one support strip crossing the heel from an upper medial side to a lower lateral side of the footwear, and at least one support strip crossing the heel from an upper lateral side to a lower medial side of the footwear, wherein the structural collar is substantially rigid and is mounted in the footwear article such that the collar at least partially encircles the ankle or lower leg of a person wearing the footwear, the collar being adjustable and/or releasable to permit entry and withdrawal of a foot from the footwear article.

2. An article of footwear according to claim 1, wherein the internal reinforcement structure comprises at least four support strips, including at least two pairs of support strips that criss-cross one another and the heel portion of the footwear.

3. An article of footwear according to claim 1, wherein the support strips forming the internal reinforcement structure are constructed from a material that is non-stretchable in the direction of the longitudinal axes of the support strips.

4. An article of footwear according to claim 1, wherein a lower end of each support strip is mounted to a structural member of the footwear in proximity to the sole.

5. An article of footwear according to claim 1, additionally comprising at least two independent woven components, including a woven heel component having a first set of strands oriented at 90° to the plane of a sole of the footwear article and another set of strands oriented at right angles to the first set of strands, and a woven forefoot component having a second set of strands oriented at 45° to the plane of the sole of the footwear article and another set of strands oriented at right angles to the second set of strands.

6. An article of footwear according to claim 1, wherein the support strips have a width of at least about 1/16".

7. An article of footwear according to claim 1, wherein the internal reinforcement structure comprises a regular network of criss-crossing, intersecting support strips with terminating intersections located at both the medial and lateral sides of the heel portion of the footwear.

8. An article of footwear according to claim 1, wherein each criss-crossing pair of support strips is arranged in a substantially mirror image relationship.

9. An article of footwear according to claim 1, comprising multiple pairs of support strips, with each pair of support strips mounted so that corresponding strips follow paths that are substantially parallel to one another.

10. An article of footwear according to claim 1, wherein each support strip forms an angle of from 35° to 80° to the plane of a sole of the footwear.

11. An article of footwear according to claim 1, wherein the support strips comprise a material selected from the group consisting of: reinforced fiberglass, metals, substantially rigid plastics, synthetic resins and composite materials.

12. An article of footwear according to claim 11, wherein the support strips comprise spring steel.

13. An article of footwear comprising an internal reinforcement structure mounted in a heel portion of the footwear article intermediate an entry portion of the footwear permitting entry of the foot into and withdrawal of the foot from the footwear article and the sole of the footwear, the internal reinforcement structure comprising at least one pair of support strips mounted on a structural collar, the support strips criss-crossing the heel portion of the footwear with at least one support strip crossing the heel from an upper medial side to a lower lateral side of the footwear, and at least one support strip crossing the heel from an upper lateral side to a lower medial side of the footwear, wherein an upper end of each support strip is pivotably mounted to the structural collar.

14. An article of footwear comprising an internal reinforcement structure mounted in a heel portion of the footwear article intermediate an entry portion of the footwear permitting entry of the foot into and withdrawal of the foot from the footwear article and the sole of the footwear, the internal reinforcement structure comprising at least one pair of support strips mounted on a structural collar, the support strips criss-crossing the heel portion of the footwear with at least one support strip crossing the heel from an upper medial side to a lower lateral side of the footwear, and at least one support strip crossing the heel from an upper lateral side to a lower medial side of the footwear, wherein the lower end of each support strip is pivotably mounted to a structural member of the footwear in proximity to the sole.

* * * * *